US009486820B2

(12) United States Patent
Bak et al.

(10) Patent No.: US 9,486,820 B2
(45) Date of Patent: Nov. 8, 2016

(54) HORIZONTALLY ROTATING CONTROLLED DROPLET APPLICATION

(71) Applicant: AGCO Corporation, Hesston, KS (US)

(72) Inventors: Justin Bak, Windom, MN (US); John Peterson, Jackson, MN (US)

(73) Assignee: AGCO Corporation, Duluth, GA (US)

( * ) Notice: Subject to any disclaimer, the term of this patent is extended or adjusted under 35 U.S.C. 154(b) by 14 days.

(21) Appl. No.: 14/432,267

(22) PCT Filed: Sep. 25, 2013

(86) PCT No.: PCT/US2013/061517

§ 371 (c)(1),
(2) Date: Mar. 30, 2015

(87) PCT Pub. No.: WO2014/052348

PCT Pub. Date: Apr. 3, 2014

(65) Prior Publication Data

US 2015/0251198 A1 Sep. 10, 2015

Related U.S. Application Data

(60) Provisional application No. 61/707,102, filed on Sep. 28, 2012.

(51) Int. Cl.

| | |
|---|---|
| ***B05B 3/02*** | (2006.01) |
| ***B05B 3/08*** | (2006.01) |
| ***B05B 3/10*** | (2006.01) |
| *B05B 15/04* | (2006.01) |

(52) U.S. Cl.

CPC ..... *B05B 3/02* (2013.01); *B05B 3/085* (2013.01); *B05B 3/1014* (2013.01); *B05B 3/1021* (2013.01); *B05B 3/1064* (2013.01); *B05B 15/0437* (2013.01)

(58) Field of Classification Search

CPC ..... B05B 3/02; B05B 3/08; B05B 3/082; B05B 3/085; B05B 3/10; B05B 3/1007; B05B 3/1014; B05B 3/1021; B05B 3/1064; B05B 15/0437

See application file for complete search history.

(56) References Cited

U.S. PATENT DOCUMENTS

| | | | | | |
|---|---|---|---|---|---|
| 2,099,988 | A | | 4/1931 | Norris | |
| 2,064,125 | A | | 10/1931 | Norris | |
| 2,066,987 | A | | 12/1932 | Norris | |
| 2,545,490 | A | | 3/1946 | Norris | |
| 3,994,438 | A | * | 11/1976 | Farmery | A01C 17/00 239/103 |
| 4,006,858 | A | * | 2/1977 | Farmery | B05B 3/085 239/156 |

(Continued)

OTHER PUBLICATIONS

International Search Authority, International Search Report for International Application No. PCT/US13/61517 mailed on Mar. 21, 2014.

*Primary Examiner* — Darren W Gorman

(57) ABSTRACT

A controlled droplet application (CDA) nozzle including a cone having plural ridges disposed longitudinally on an interior surface of the cone; and a fin assembly connected to the interior surface, the fin assembly comprising a plurality of fins extending between a central portion of the cone and the interior surface, wherein adjacent pairs of the plurality of fins and the interior surface at least partially define a respective compartment for the collection of a defined volume of fluid.

10 Claims, 7 Drawing Sheets

(56) References Cited

U.S. PATENT DOCUMENTS 4,221,332 A * 9/1980 Bals ..... B05B 3/1064
239/223
4,222,523 A * 9/1980 Bals ..... B05B 3/0427
239/216
4,225,084 A * 9/1980 Bals ..... B05B 3/04
239/223
4,368,849 A * 1/1983 Farmery ..... A01C 17/00
239/222
4,429,833 A 2/1984 Meisner et al.
4,619,401 A * 10/1986 Hardman ..... B64D 1/18
239/214.17
4,712,738 A * 12/1987 Gill ..... A01M 7/0028
239/214
4,795,095 A * 1/1989 Shepard ..... B05B 3/105
239/214.17
4,948,051 A * 8/1990 Gill ..... B05B 3/1014
239/223

* cited by examiner

HORIZONTALLY ROTATING CONTROLLED DROPLET APPLICATION

CROSS REFERENCE TO RELATED APPLICATION

This application claims the benefit of U.S. Provisional Application No. 61/707,102, filed Sep. 28, 2012, which is hereby incorporated by reference in its entirety.

TECHNICAL FIELD

The present disclosure is generally related to spraying technology, and, more particularly, to controlled droplet applications.

BACKGROUND

A controlled droplet application (CDA) nozzle operates on a completely different principle than conventional hydraulic nozzles. CDA nozzles deposit liquid fluid to be applied on the inside of a spinning cone. The inside of the cone may be lined with ridges traveling from the narrow end of the cone to the wide end. These ridges help impart rotational energy to the liquid fluid, spinning it faster. The ends of the ridges are used to shear the flowing liquid into droplets. As the CDA cone spins faster, the smaller droplets get sheared and released from the end of the ridges, which enables the spectrum of droplet sizes to be controlled by adjusting the speed of the CDA cone.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DESCRIPTION OF EXAMPLE EMBODIMENTS

Overview

Figure 1A:
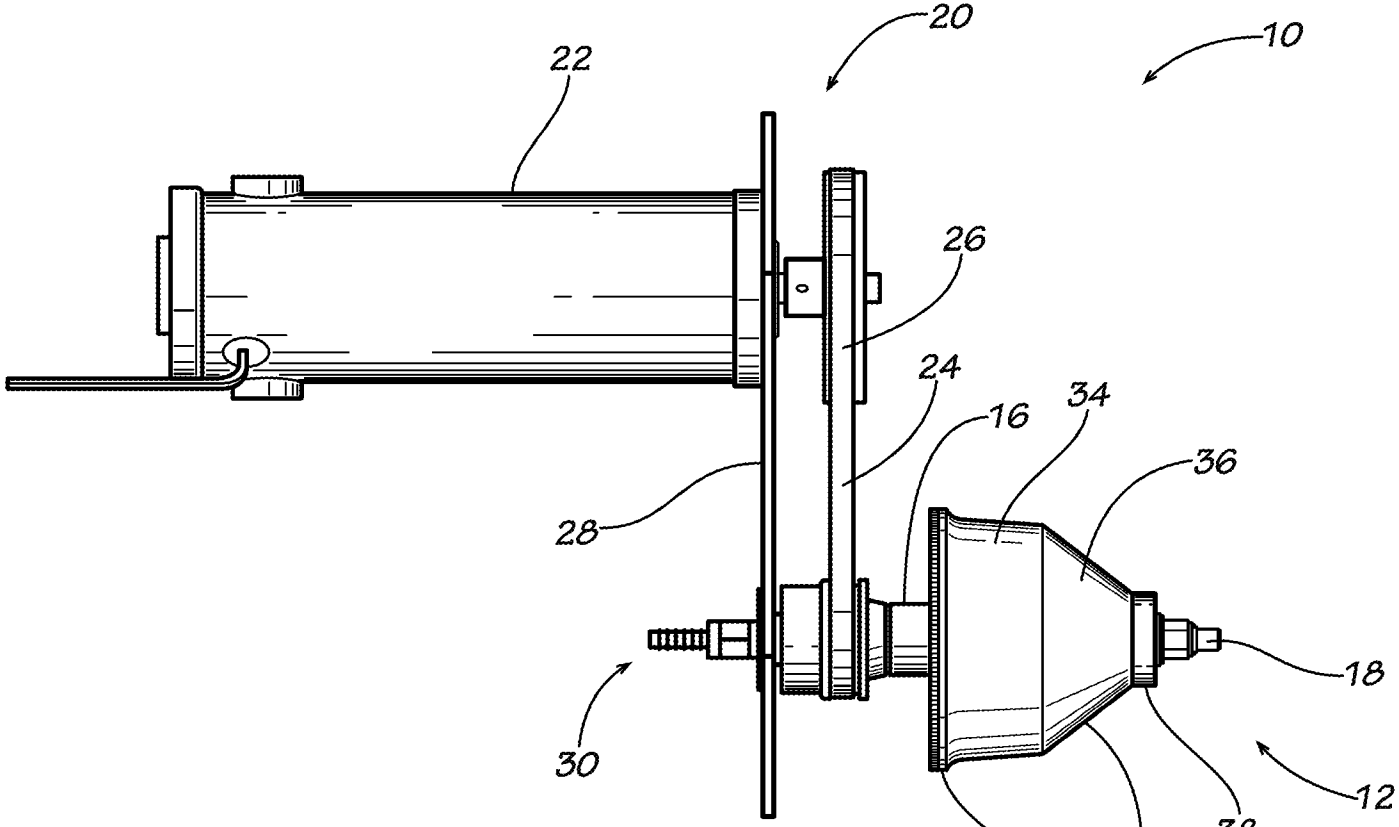
FIG. 1A is a schematic diagram generally depicting an embodiment of an example controlled droplet application (CDA) system with a CDA nozzle cone in horizontal orientation.

In one embodiment, a controlled droplet application (CDA) nozzle comprising a cone having plural ridges disposed longitudinally on an interior surface of the cone; and a fin assembly connected to the interior surface, the fin assembly comprising a plurality of fins extending between a central portion of the cone and the interior surface, wherein adjacent pairs of the plurality of fins and the interior surface at least partially define a respective compartment for the collection of a defined volume of fluid.

DETAILED DESCRIPTION

Certain embodiments of a controlled droplet application (CDA) system and method are disclosed that enable a CDA nozzle cone to rotate with its axis in a horizontal orientation without producing an eccentric fluid spray pattern. In one embodiment, horizontal operation (and/or operations in other orientations) of the rotating CDA nozzle cone is achieved through the use of a fin assembly comprising a plurality of fins that is disposed in the nozzle cone (hereinafter, the latter also simply referred to as a cone). The fin assembly may separate the cone into wedge-shaped sections (e.g., when viewed in pan view) or compartments that ensure that an even or substantially even amount of fluid enters each compartment of the cone.

Conventional CDA nozzles cones are spun in the vertical or near vertical (e.g., within ten (10) degrees of the vertical axis) axis, enabling an even spray of droplets in every direction around the nozzle cone. However, such conventional CDA nozzles are limited to rotating the cone near the vertical axis to ensure an even distribution of fluid around the inside of the cone. For instance, one motivation for limiting the orientation of previous CDA nozzles to the vertical or near vertical orientation is a concern that the angle of rotation of the rotational axis relative to vertical results in eccentric distribution rather than circular distribution, the latter a characteristic of CDA nozzles. One or more embodiments of CDA systems and methods enable a circular distribution of droplets regardless of the angle of rotation of the rotational axis.

Having summarized certain features of CDA systems of the present disclosure, reference will now be made in detail to the description of the disclosure as illustrated in the drawings. While the disclosure will be described in connection with these drawings, there is no intent to limit it to the embodiment or embodiments disclosed herein. For instance, in the description that follows, the focus is on a horizontal orientation of the CDA nozzle (including cone), with the understanding that vertical or other orientations may be achieved in certain embodiments. Further, although the description identifies or describes specifics of one or more embodiments, such specifics are not necessarily part of every embodiment, nor are all various stated advantages necessarily associated with a single embodiment or all embodiments. On the contrary, the intent is to cover all alternatives, modifications and equivalents included within the spirit and scope of the disclosure as defined by the appended claims. Further, it should be appreciated in the context of the present disclosure that the claims are not necessarily limited to the particular embodiments set out in the description.

Figure 1B:
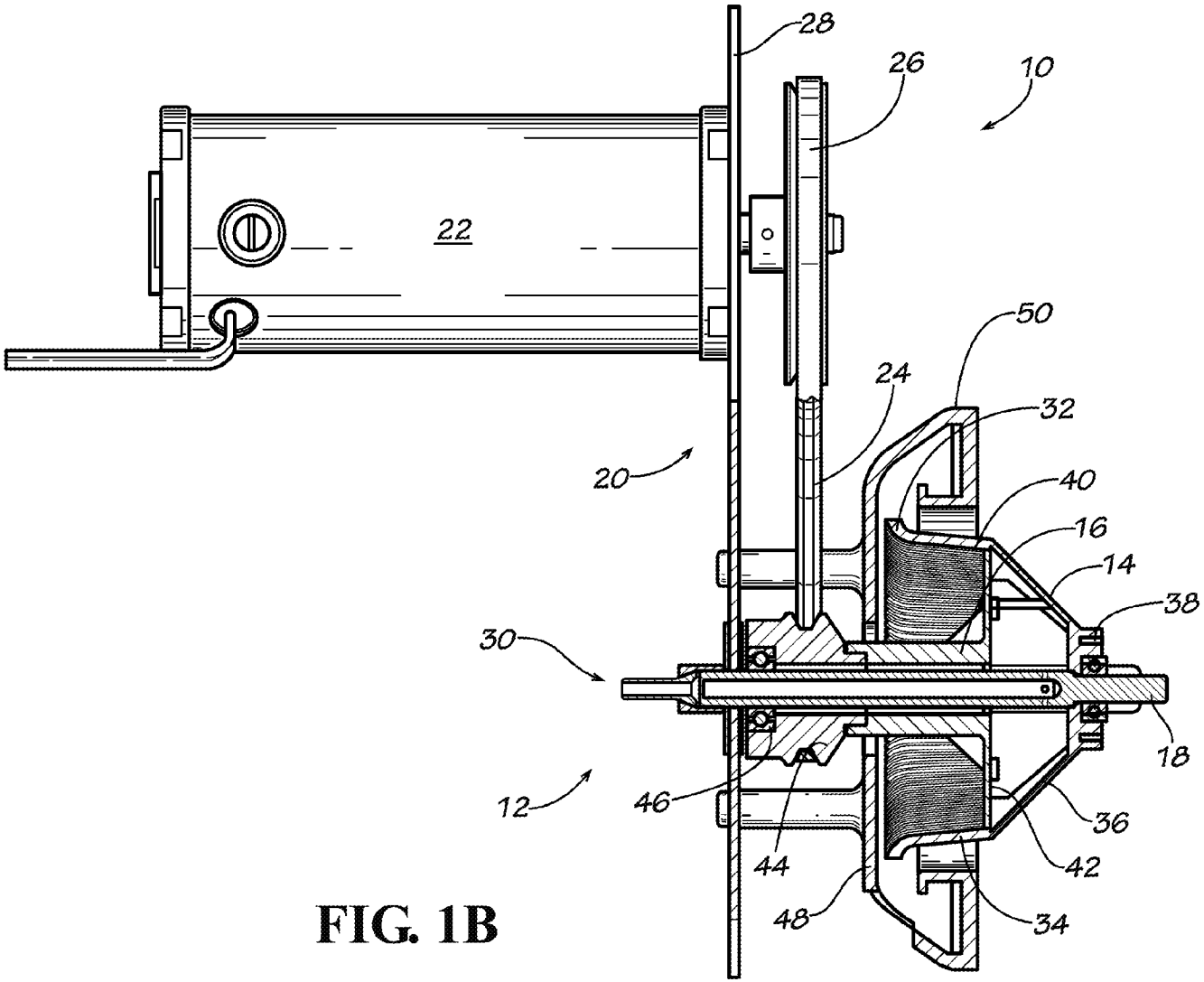
FIG. 1B is a schematic diagram showing additional features in cut-away view of the example CDA system shown in FIG. 1A.
Figure 1C:
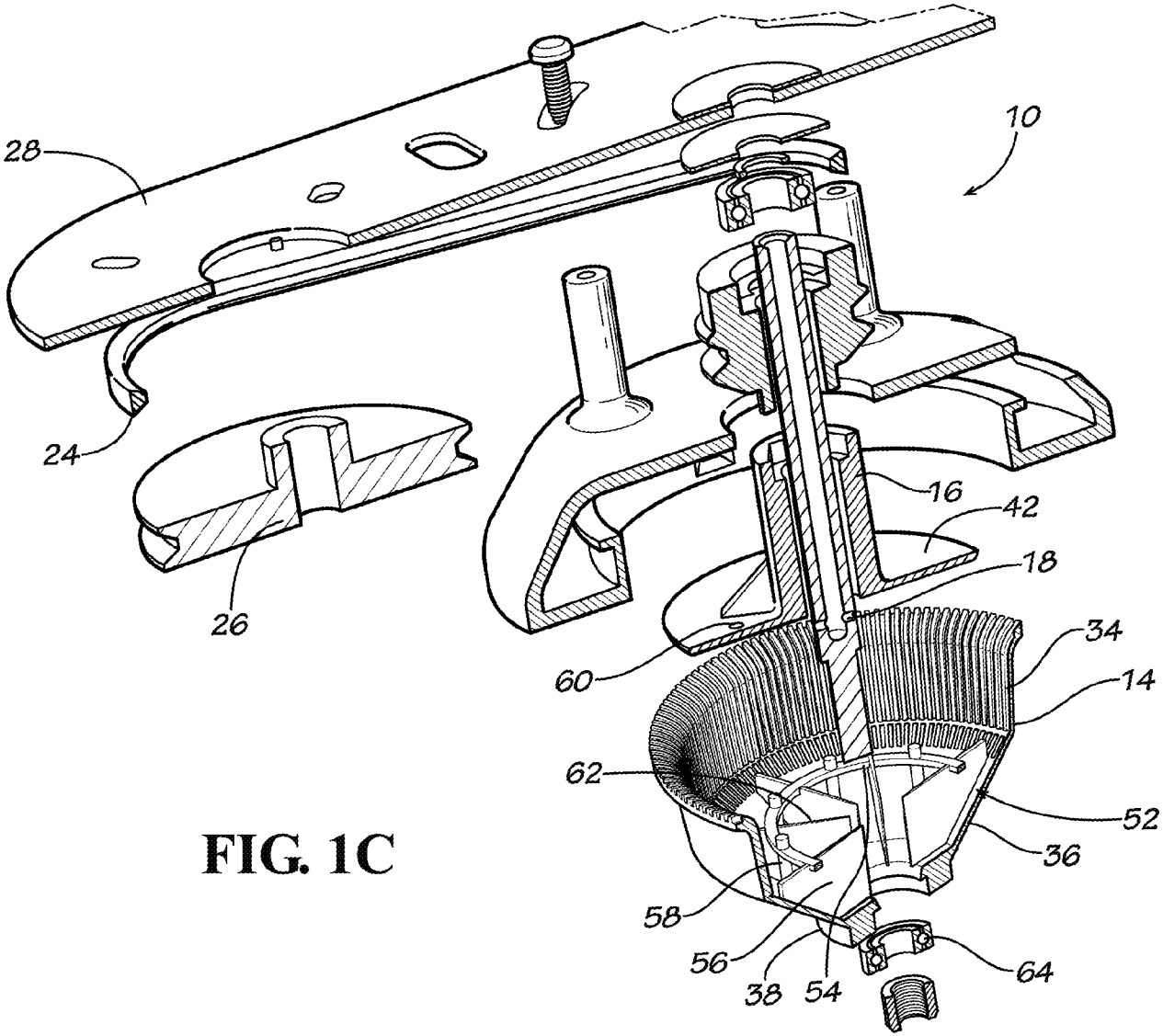
FIG. 1C is a schematic diagram showing certain features in exploded view of the example CDA system shown in FIG. 1A.

FIGS. 1A-1C depict several illustrations of an embodiment of a CDA system 10, with each illustration focusing on select features of the system. Referring now to FIG. 1A, shown is an embodiment of an example CDA system 10. One having ordinary skill in the art should appreciate in the context of the present disclosure that the CDA system 10 shown in, and described in association with, FIG. 1A (and FIGS. 1A-1C) is merely illustrative, and that other system arrangements with fewer or additional components are contemplated to be within the scope of the disclosure. As is evident by comparison among FIGS. 1A-1C, certain features are omitted in each figure to emphasize other features. The CDA system 10 may be used in an agricultural environment, such as to spray liquid fluids (e.g., chemicals) on crops, bare ground, etc., as pre-emergence and/or post-emergence herbicides, fungicides, and insecticides. The CDA system 10 may be secured to a tractor frame, boom, among other agricultural equipment (e.g., sprayer machines) similar to implementations for conventional CDA nozzles. In some embodiments, the CDA system 10 may be used in other environments, such as those requiring the application of other types of liquid fluids (hereinafter, the latter referred to simply as fluids) to other surfaces. The CDA system 10 exhibits some of the well-known characteristics of conventional CDA nozzles, including the provision of a substantially uniform size liquid droplet based on low flow inputs.

The CDA system 10 comprises a CDA nozzle 12 that is depicted in FIG. 1A in the horizontal orientation, though any orientation may be used. The CDA nozzle 12 comprises a cone 14, partially through which a shaft 16 runs longitudinally. Disposed concentrically within the shaft is a hollow spindle 18 that receives fluid introduced into the nozzle 12. The shaft 16 is coupled to the cone 14 and is engaged by a drive system 20 to cause rotation of the cone 14 relative to the stationary spindle 18. The cone 14 rotates to produce droplets from an inputted fluid stream. In one embodiment, the drive system 20 comprises a rotational actuator 22 and pulley 24. The pulley 24 engages a wheel 26 of the rotational actuator 22 and also engages the shaft 16 of the nozzle 12 to cause rotation of the cone 14. The drive system 20 and the nozzle 12 are mounted to a frame 28 (via a mounting assembly as described further below in association with FIGS. 1B-1C), which may be connected (e.g., in adjustable or fixed manner) to a boom of a self-propelled agricultural machine (e.g., sprayer machine) or to a towed implement. In one embodiment, the frame 28 rigidly secures the aforementioned components with respect to each other.

Fluid is provided to the input 30, which connects to (or is integrated with in some embodiments) the spindle 18. The fluid may be provided through a flow control apparatus or system, as is known in the art. For instance, a flow control system may meter a defined volume of fluid into the spindle 18.

Evident from FIG. 1A is that the cone 14 is comprised of different geometries throughout the cone structure. For instance, the cone 14 comprises a lip portion 32 from which the uniform droplets are dispersed from grooves (the grooves formed by plural ridges in the interior surface of the cone 14, the ridges breaking off the droplets as the fluid flows from the grooves) in circular fashion to a target, such as the ground or foliage (e.g., crops, weeds, etc.). In some embodiments, deflectors (e.g., a directional shroud) may be used (e.g., incorporated in, or associated with, the cone 14) to cause the fluid dispersion pattern imposed on the target to be truncated (e.g., less than a circular dispersion reaching the target, such as directionally controlled). The cone 14 also comprises a wide portion 34 having a corresponding interior surface that also comprises the grooves to channel the fluid to the lip portion 32 as the cone 14 rotates. The cone 14 further comprises a narrow portion 36 with a diameter that decreases from the wide portion 34 to a base 38 of the narrow portion 36 of the cone 14. Within the cone 14 corresponding to an interior surface of the narrow portion 36 is a fin assembly, as described further below.

In one example operation, the rotational actuator 22 of the drive system 20 provides rotational motion to rotate the cone 14. In other words, the pulley 26 transfers the rotational motion of the rotational actuator 22 to the shaft 16, which through coupling between the shaft 16 and the cone 14, causes the cone 14 to rotate. The shaft 16 rotates around the hollow and stationary spindle 18. In one embodiment, an even flow of fluid is injected by a flow control system into the input 30. The liquid fluid flows through the hollow spindle 18 and is discharged at plural holes adjacent the base 38 (in the interior of the cone 14). Fins of a fin assembly located internal to the cone 14 divide and compartmentalize the fluid evenly inside the cone 14 and ensure that the cone 14 produces an even distribution of uniformly-sized droplets.

It should be appreciated within the context of the present disclosure that variations of the aforementioned CDA system 10 are contemplated and considered to be within the scope of the disclosure. For instance, in some embodiments, the drive system 20 may include a belt, gears, chain, hydraulic motor, pneumatic motor, etc. In some embodiments, the depicted drive system 20 may be omitted in favor of drive system that includes a direct coupling between a motor and the cone 14. In some embodiments, additional structure may be included, such as a directional shroud to direct the flow of droplets exclusively to the desired direction (or directions), precise speed control of the cone 14, a fan to assist droplet travel and penetration (e.g., into foliage), among other structures. Although not limited to a specific performance, some example performance metrics of the CDA system 10 may include a minimum flow rate of approximately 0.05 gallons per minute (GPM), a maximum flow rate of approximately 0.3 GPM, a minimum cone speed of approximately 2500 RPM, and a maximum cone speed of approximately 5000 PRM. These metrics are merely illustrative, and some embodiments may have greater or lower values.

Attention is now directed to FIG. 1B, which provides a cutaway view of certain features of the CDA system 10 shown in FIG. 1A. Recapping from the description above, the CDA system 10 comprises the CDA nozzle 12. The CDA nozzle 12 comprises the cone 14. In one embodiment, the cone 14 comprises a geometrical configuration that includes the lip portion 32 from which droplets are dispersed to a target, the wide portion 34, and the narrow portion 36 that includes the base 38. As depicted in FIG. 1B, plural ridges 40 are disposed longitudinally at least on the interior surface corresponding to the wide portion 34 and the lip portion 32.

The CDA system 10 further comprises the shaft 16, which extends into the cone 14. The shaft 16 surrounds (e.g., concentrically) at least a portion of the hollow spindle 18. The hollow spindle 18 receives fluid (e.g., from a flow control system) at the input 30 and dispenses the fluid into the interior of the cone 14 corresponding to the narrow portion 36 (e.g., proximal to the base 38). Introduced in FIG. 1B is a circular cap 42 that segments the interior of the cone 14 in a plane proximal to the transition between the wide portion 34 and the narrow portion 36. In one embodiment, the cap 42 is integrated (e.g., molded, cast, etc.) with the shaft 16. In some embodiments, the cap 42 is coupled to the shaft 16 according to other known fastening mechanisms, such as via welding, riveting, screws, etc. The cap 42 is also mounted to a fin assembly as described further below. The shaft 16 further comprises a hexagonal key portion 44 and bearing assembly 46 disposed between the frame 28 and the cone 14. The key portion 44 provides an area of engagement for the pulley 24, of the drive system 20, at the nozzle 12, the other area of engagement at the wheel 26 associated with the rotational actuator 22 of the drive system 20. The bearing assembly 46 (along with a bearing assembly on an opposing end of the spindle 18, as described below) enables the spindle 18 to guide the rotation of the shaft 16 and cone 14 relative to the stationary spindle 18, as driven by the drive system 20.

Also depicted in FIG. 1B is a mounting assembly 48 which includes a shroud 50 that enables anywhere from a fully circular spray of fluid from the outlet of the cone 14 to a truncated spray pattern, depending on the configuration of the shroud 50. For instance, the shroud 50 may be offset from the outlet (e.g., lip portion 32) of the cone 14 (e.g., lifted closer to the frame 28 to avoid interfering with the discharge of the fluid droplets) to enable a fully circular spray pattern of uniform droplets, or configured with one or a plurality of interfering arc portions to enable a truncated, directional spray pattern. In some embodiments, the shroud 50 may be omitted. The mounting assembly 48 also, as the name implies, secures the shroud 50 to the frame 28. The input end 30 extending beyond the frame 28 and a nut at the opposite end of the spindle 18 compress the frame 28, the pulley 24, shaft 16, and the cone 14 together. The shroud 50 is mounted independently onto the frame 28, as noted above, and around the rotating sub-assembly (e.g., pulley 24, shaft 16, and cone 14), and hence the rotating sub-assembly rotates approximately in the middle of the shroud 50. In general, the shroud 50 incorporates circular fluid spray deflection/blocking functionality, reclamation functionality (e.g., reclamation of the blocked circular fluid spray), and mounting functionality (e.g., mounting to the frame via the mounting assembly 48). Each of these functionalities may be performed by the shroud 50 embodied in multiple detachably (e.g., modular) components or by a fully integrated (molded or cast) assembly.

Referring to FIG. 1C, an exploded view of certain features of the CDA system 10 of FIGS. 1A-1B is shown. The frame 28, wheel 26, pulley 24, and shaft 16 have already been described in association with FIGS. 1A-1B, and hence further discussion of the same is omitted here for brevity except where noted below. Of particular focus for purposes FIG. 1C is a fin assembly 52 in the interior of the cone 14 corresponding to the narrow portion 34, which includes a ring 54, a plurality of fins 56 coupled to or integrated with the ring 54, and a plurality of pins 58 disposed between each pair of fins 56. The fin assembly 52 depicted in FIG. 1C is one example configuration, and it should be appreciated that other configurations of the fin assembly (e.g., with a fewer or greater number of pins 58 or fins 56) are contemplated to be within the scope of the disclosure. The fin assembly 52 is connected to the interior surface of the cone 14 corresponding to the narrow portion 36, and in particular, connected via the pins 58. Further, the cap 42 of the shaft 16 mounts to the fin assembly 52 via the pins 58 and the cap holes 60 of the cap 42. The cap 42 rests on an edge 62 of each fin 56 of the fin assembly 52. Note that the shaft 16 surrounds at least a portion of the spindle 18 (e.g., between the frame 28 and the cap 42). A bearing assembly 64 is located opposite the bearing assembly 46 (FIG. 1B) along the spindle 18 and proximal the base 38. The stationary spindle 18 guides the rotation of the shaft 16 and cone 14 via the two bearing assemblies 46 and 66.

Figure 2:
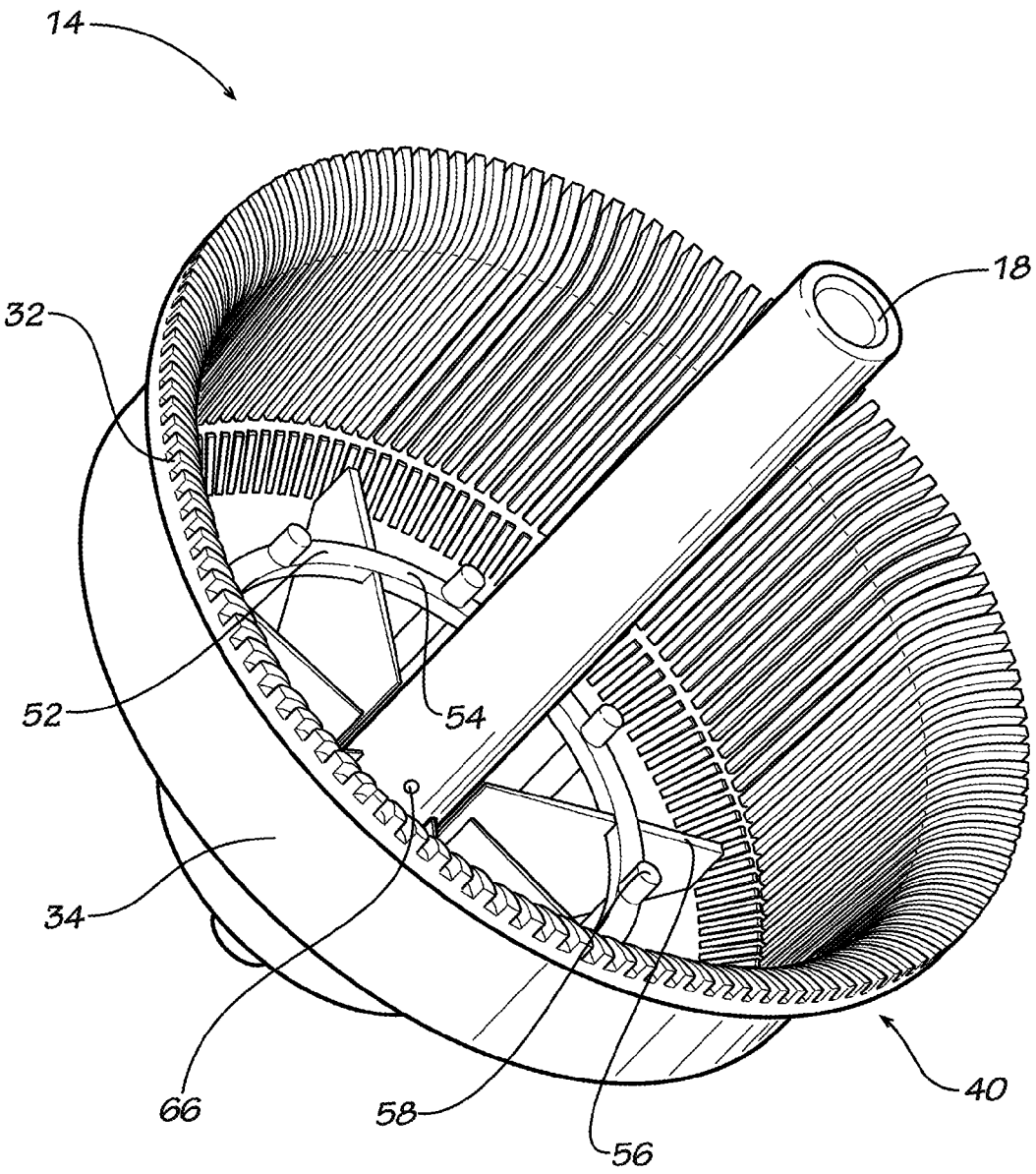
FIG. 2 is a schematic diagram of an embodiment of an example CDA nozzle in a perspective view showing a portion of an interior of a CDA nozzle cone.

Having described one embodiment of an example CDA system 10, attention is directed to FIG. 2, which shows, in perspective, a portion of the interior of one embodiment of the cone 14 (with some features omitted for purposes of discussion, such as the cap 42 and shaft 16). It should be appreciated within the context of the present disclosure that variations in the depicted structure are contemplated for certain embodiments, such as fewer or additional fins, and/or the extension (or reduction) of the quantity of ridges along a greater (or lesser) area of the interior surface of the cone 14. As depicted in FIG. 2, the cone 14 comprises the hollow spindle 18 centrally disposed in the one 14, as described above. The spindle 18 comprises one or more holes 66 proximal to the base 38 (FIGS. 1A-1C) that deposits the fluid into the interior space of the cone 14 proximal to the base 38. The cone 14 further comprises the longitudinal, discontiguous ridges 40 disposed on at least a portion of the interior surface (e.g., corresponding to the lip portion 32, wide portion 34, and a part (e.g., less than the entirety) of the narrow portion 36 (FIGS. 1A-1C). In some embodiments, the ridges 40 may occupy a larger amount of the interior surface, or a smaller part in some embodiments, or be contiguous throughout the interior surface of cone 14. Between the ridges 40 are grooves which enable the channeling of fluid injected from the spindle 18 to dispersion as droplets beyond the lip portion 32.

The interior of the cone 14 further comprises the fin assembly 52, as described above in association with FIG. 1C. In one embodiment, the fin assembly 52 is disposed in an interior space adjacent the narrow portion 36 (e.g., the narrow portion 36 having a decreasing diameter from the wide portion 34 to the base 38 (FIGS. 1A-1C)). As described above, the fin assembly 52 comprises the ring 54 that, in one embodiment, encircles a central or center region of the cone 14 occupied by the spindle 18. In one embodiment, a central axis of the ring 54 is coincident with a central axis of the spindle 18. The ring 54 is integrated with (e.g., casted or molded, or in some embodiments, affixed to) the plurality of the fins 56. The fins 56 extend from a location longitudinally adjacent the spindle 18 to the interior surface of the cone 14. In one embodiment, one or more edges of each fin 56 is flush (e.g., entirely, or a portion thereof) with the interior surface of the cone 14. In some embodiments, one or more edges of each fin 56 is connected (e.g., along the entire edge or a portion thereof in some embodiments) to the interior surface of the cone 14. In some embodiments, a small gap is disposed between one or more edges of each fin 56 (or a predetermined number less than all of the fins 56) and the interior surface closest to the fin 56. In some embodiments, the fins 56 may be affixed to the ring 54 by known fastening mechanisms (e.g., welds, adhesion, etc.) or integrations (e.g., molded, cast, etc.). The ring 54 further comprises the plural pins 58 that enable the mounting of the cap 42 (FIG. 1C) of the shaft 16 (FIG. 1) to the fin assembly 52, which also enables the shaft 16 to cause the rotation of the cone 14. The pins 58 also secure the fin assembly 52 to the interior surface of the narrow portion 36.

Figure 3:
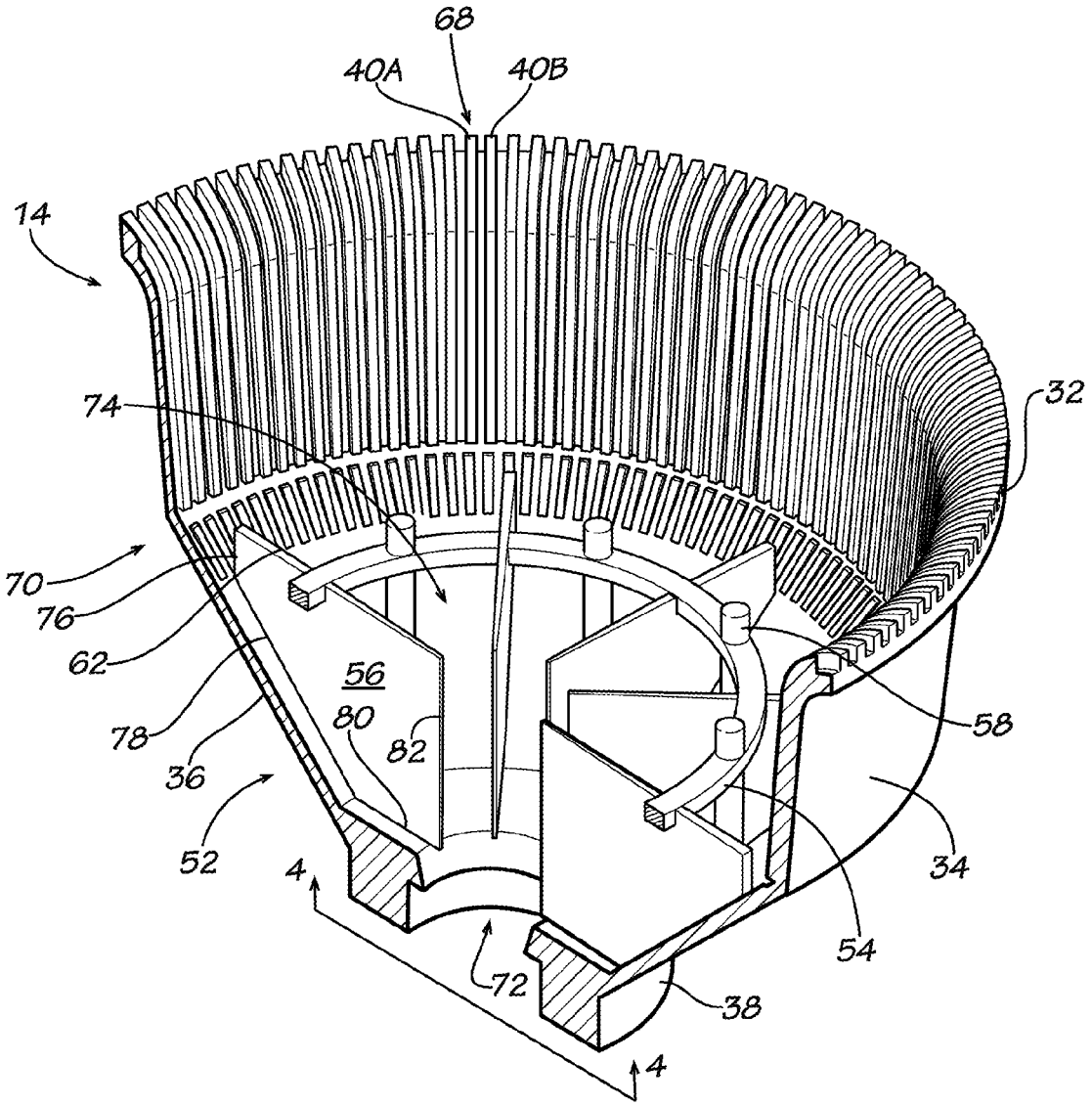
FIG. 3 is a schematic diagram of an embodiment of an example CDA nozzle cone in a perspective, partial cutaway view showing a portion of an interior of the cone.
Figure 4:
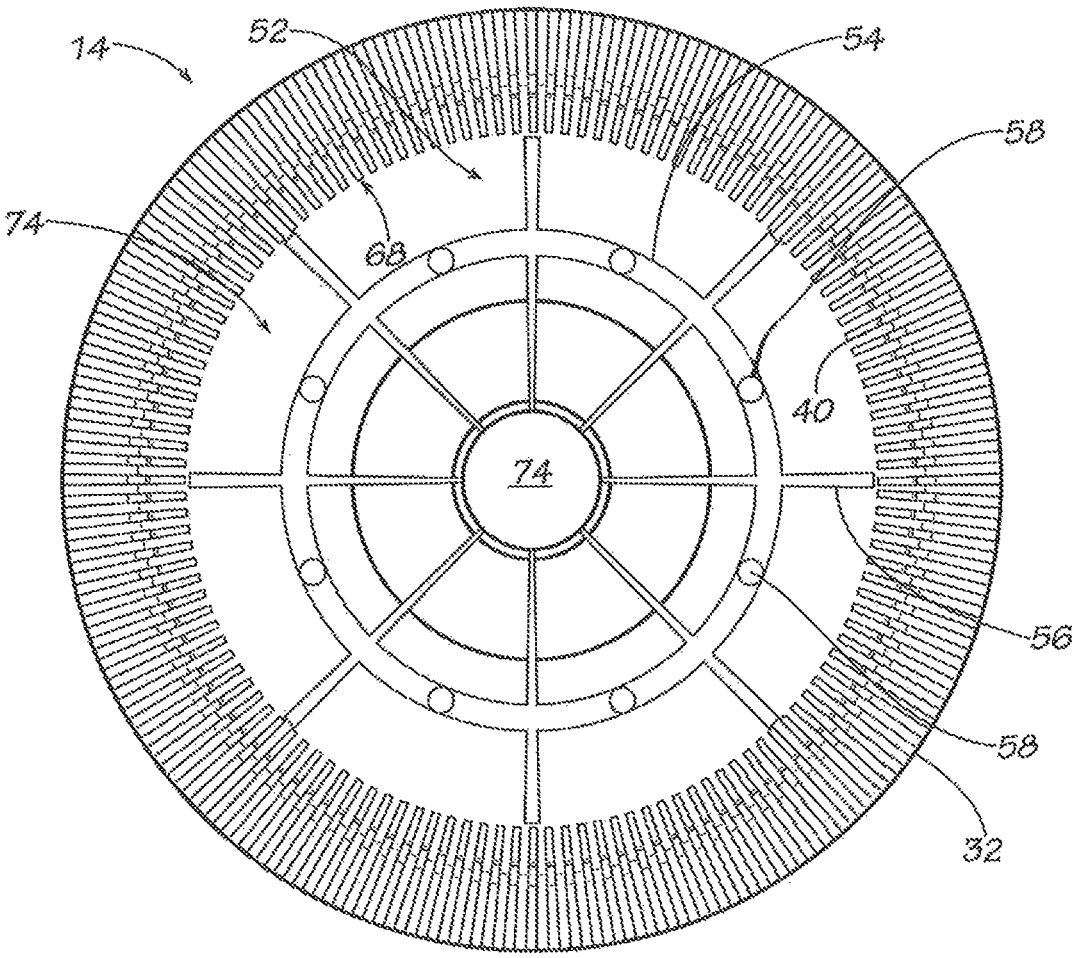
FIG. 4 is a schematic diagram of an embodiment of an example CDA nozzle cone in a top plan view showing a portion of an interior of the cone.

FIGS. 3 and 4 provide additional schematic diagrams of the cone 14, and in particular, a cutaway of certain features of an interior of the cone 14 as well as a cross section along 4-4, respectively. It should be appreciated in the context of the present disclosure that some features are omitted (e.g., the shaft 16 with the cap 42 and the spindle 18) for brevity and to avoid obfuscating details of certain features. As noted above, the cone 14 comprises the lip portion 32, wide portion 34, and narrow portion 36, which in one embodiment includes the base 38. In one embodiment, the narrow portion 36 is secured to, and has a corresponding interior volume that is occupied by, the fin assembly 52. The fin assembly 52 comprises the ring 54, the plurality of fins 56, and the plural pins 58. The cone 14 depicted in FIGS. 3 and 4 provide a closer view of the ridges 40, including as an example, ridges 40A and 40B that define in between a groove 68 that enables the flow of fluid as the cone 14 rotates (and fluid is discharged from the spindle 18). The interior surface of the cone 14 comprises a delineation of the change in diameter from the wide portion 34 and the narrow portion 36, the delineation physically comprising a gap 70 in the ridges 40 that is disposed circumferentially around the interior surface of the cone 14. The gap 70 also provides a discontinuity, longitudinally, in the ridges 40. In some embodiments, there may be plural gaps at different circumferential locations, or in some embodiments, no gaps. As evident from FIGS. 3-4, the ridges 40 run longitudinally (e.g., longitudinally coincident with a central region 72 that is occupied by the spindle 18 and shaft 16 (FIG. 2)) on the interior surface of the lip portion 32 and wide portion 34, as well as partially in the narrow portion 36 (e.g., adjacent the gap 70). In some embodiments, when the cone 14 is oriented vertically (i.e., rotates around a vertical axis), the cap 42 (FIG. 1C) is disposed proximal to and slightly above the gap 70. Other variations in the cap location are contemplated to be within the scope of the disclosure.

The fin assembly 52 is secured (via the pins 58) to the interior surface of the cone 14, providing a structural fastener for the cap 42 (FIG. 1C) of the shaft 16 and enabling the distribution of an equal amount of fluid (e.g., volume of fluid) to be imposed into the grooves 68 defined by the ridges 40 that are partially located in the narrow portion 36. That is, while the cone 14 rotates, the fluid that is dispensed from the spindle 18 (e.g., from plural holes, one hole 66 shown in FIG. 2) equally or substantially equally fills each compartment 74 defined by a pair of adjacent fins 56, the spindle 18 (FIG. 2), the cap 42 (FIG. 1C), and the interior surface of the cone 40 corresponding to the narrow portion 36. As the fluid is released (e.g., spills) past the end or notch 76 of each fin 56 for each compartment 74 and enters the grooves 68 defined by the ridges 40 in the narrow portion 36, the cap 42 holds back the excessive fluid. The fins 56 also provide the fluid with a starting momentum to spread around the interior of the cone 14 with centrifugal force.

In one embodiment, each fin 56 comprises the edges described above, including the edge 62 upon which the cap 42 is mounted and the end of each fin 56 or notch 76 where the fluid passes to impose upon the grooves 68. In one embodiment, each fin 56 also comprises edges 78 and 80 that are flush with (and/or connected to) an angled, interior surface of the narrow portion 36 and the base 38, respectively. Each fin 56 further comprises another edge 82 adjacent to the central region 70 (and hence adjacent to, and flush or substantially flush with, the spindle 18). In some embodiments, the fins 56 are configured somewhat in a wedge structure. Other geometric configurations of the fins 56 are also contemplated to be within the scope of the disclosure.

Figure 5:
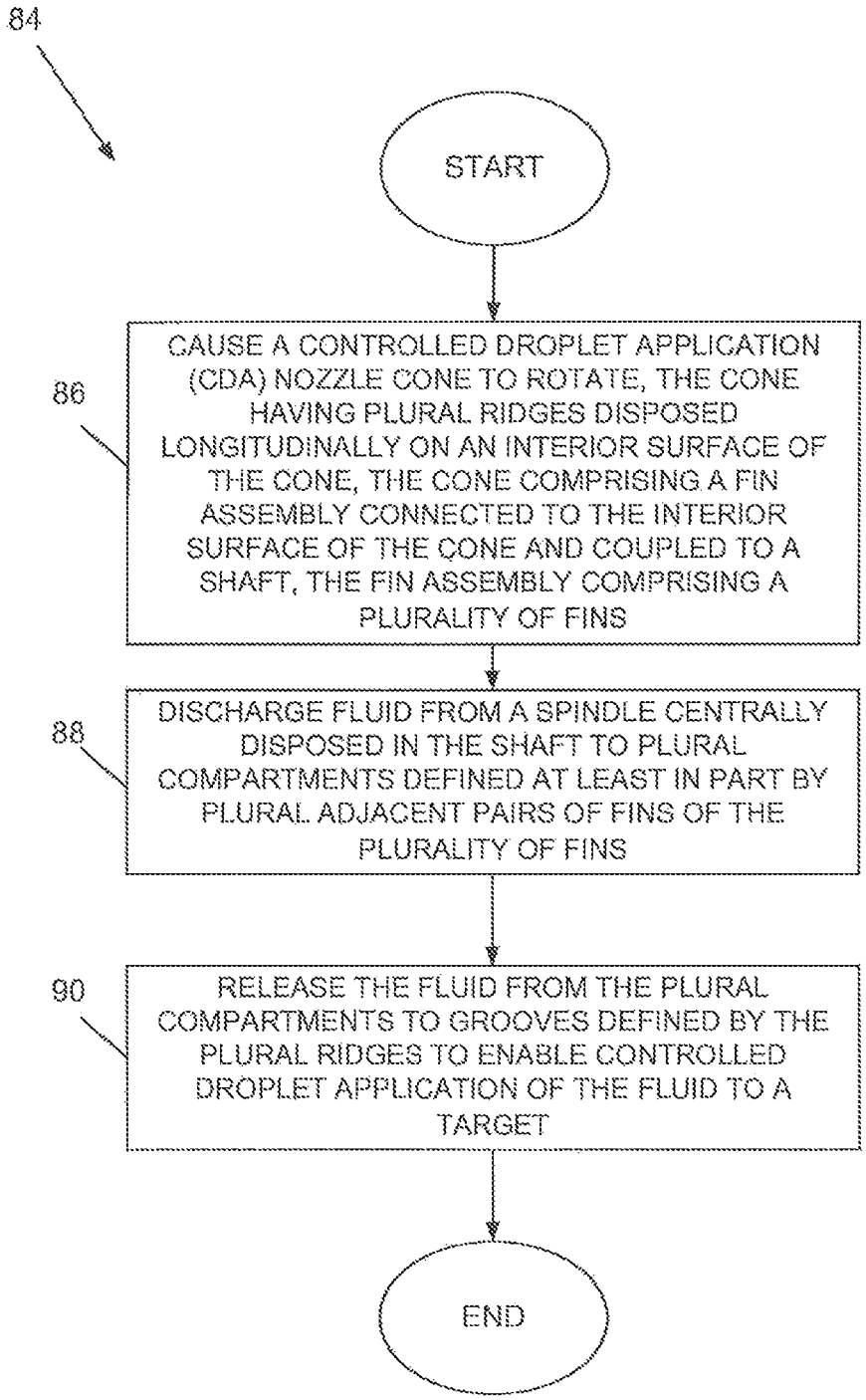
FIG. 5 is a flow diagram of an embodiment of an example CDA method.

Having described certain embodiments of a CDA system 10, it should be appreciated within the context of the present disclosure that one embodiment of a CDA method (e.g., as implemented in one embodiment by the CDA system 10, though not limited to the specific structures shown in FIGS. 1A-4), denoted as method 84 and illustrated in FIG. 5, comprises causing a controlled droplet application (CDA) nozzle cone to rotate, the cone having plural ridges disposed longitudinally on an interior surface of the cone, the cone comprising a fin assembly connected to the interior surface of the cone and coupled to a shaft, the fin assembly comprising a plurality of fins (86); discharging fluid from a spindle centrally disposed in the shaft to plural compartments defined at least in part by plural adjacent pairs of fins of the plurality of fins (88); and releasing the fluid from the plural compartments to grooves defined by the plural ridges to enable controlled droplet application of the fluid to a target (90).

Any process descriptions or blocks in flow diagrams should be understood as merely illustrative of steps performed in a process implemented by a CDA system, and alternate implementations are included within the scope of the embodiments in which functions may be executed out of order from that shown or discussed, including substantially concurrently or in reverse order, depending on the functionality involved, as would be understood by those reasonably skilled in the art of the present disclosure.

It should be emphasized that the above-described embodiments of the present disclosure are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and protected by the following claims.

At least the following is claimed:

1. A controlled droplet application (CDA) system, comprising:

a shaft;

a spindle concentrically disposed within the shaft;

a cone having plural ridges disposed longitudinally on a first portion and partially on a second portion of an interior surface of the cone, the plural ridges on the interior surfaces of the first and second portions separated along the circumference of the cone by a gap; and a fin assembly secured to the second portion and coupled to the shaft, the fin assembly comprising a plurality of fins, each fin having a first edge adjacent the spindle, second and third edges adjacent the second portion, and a fourth edge adjacent the ridges that are partially on the interior surface of the second portion.

2. The CDA system of claim 1, wherein the second portion comprises a base having an interior surface in contact with the third edge.

3. The CDA system of claim 2, wherein the second portion comprises an interior surface that is angled relative to a longitudinal axis of the spindle, the angled interior surface in contact with the second edge.

4. The CDA system of claim 1, wherein the fin assembly comprises a ring from which the plurality of fins extend to the interior surface of the second portion, the ring further comprising plural pins, each pin disposed between an adjacent pair of the plurality of fins, the pins connected to the interior surface of the second portion.

5. The CDA system of claim 4, wherein the shaft comprises a circular cap, the cap disposed adjacent a fifth edge of the plurality of fins and mounted to the fin assembly via the plural pins.

6. The CDA system of claim 1, wherein the spindle is hollow and stationary, the spindle comprising plural holes proximal to a base of the cone to allow a discharge of fluid into the cone.

7. The CDA system of claim 6, wherein each adjacent pair of the plurality of fins, the interior surface of the second portion, and the spindle define a respective compartment that enables collection of a discrete volume of the discharged fluid.

8. The CDA system of claim 6, wherein the cone comprises a plurality of compartments defined by the plurality of fins, the interior surface of the second portion, and the spindle, the plurality of compartments separating the discharged fluid into discrete and equal volumes.

9. The CDA system of claim 1, further comprising bearings associated with opposing sides of the spindle that enable the shaft and the cone to coincidently rotate relative to the spindle.

10. The CDA system of claim 8, further comprising:

a frame;

a mounting assembly; and a drive system mounted to the frame, the mounting assembly securing the shaft to the frame, the drive system configured to rotate the shaft and cause the cone to rotate, the rotation configured to cause an even distribution of uniformly-sized droplets from the cone.

* * * * *